US010815725B2

(12) United States Patent
Lei

(10) Patent No.: US 10,815,725 B2
(45) Date of Patent: Oct. 27, 2020

(54) UNIDIRECTIONAL WIRE TAKE-UP MECHANISM

(71) Applicant: Zheng Bang Lei, Shenzhen (CN)

(72) Inventor: Zheng Bang Lei, Shenzhen (CN)

( * ) Notice: Subject to any disclaimer, the term of this patent is extended or adjusted under 35 U.S.C. 154(b) by 45 days.

(21) Appl. No.: 16/370,018

(22) Filed: Mar. 29, 2019

(65) Prior Publication Data

US 2020/0198927 A1 Jun. 25, 2020

(30) Foreign Application Priority Data

Dec. 21, 2018 (CN) ..... 2018 2 2157124

(51) Int. Cl.
*B65H 75/44* (2006.01)
*E06B 9/322* (2006.01)
*E06B 9/80* (2006.01)

(52) U.S. Cl.
CPC ..... *E06B 9/322* (2013.01); *B65H 75/4442* (2013.01); *E06B 9/80* (2013.01); *B65H 2701/36* (2013.01); *E06B 2009/3222* (2013.01); *E06B 2009/3225* (2013.01); *E06B 2009/807* (2013.01)

(58) Field of Classification Search
CPC ..... B65H 75/4442; B65H 75/4447; E06B 9/303–308; E06B 9/32; E06B 9/322; E06B 9/56; E06B 2009/3225; E06B 2009/807
See application file for complete search history.

*Primary Examiner* — William E Dondero
(74) *Attorney, Agent, or Firm* — Sinorica, LLC

(57) ABSTRACT

A unidirectional wire take-up mechanism includes a fixing seat, a reel, a spindle, a unidirectional bearing, a bearing sleeve, a damping bounce member, and a positioning shaft. When the curtain is pulled down, the unidirectional bearing is locked, and the reel links the spindle through the bearing sleeve to rotate counterclockwise. When the spindle is rotated, the spindle and the damping bounce member generate a frictional force to form a damping effect, thereby providing a reaction force when the wire is released and offsetting part of the gravity of the curtain and effectively slowing down the speed and impact force when the curtain falls. When the curtain is rolled up, the reel links the bearing sleeve to rotate clockwise relative to the spindle, and the spindle and the damping bounce member have no relative movement, and the rotation has no resistance.

7 Claims, 3 Drawing Sheets

UNIDIRECTIONAL WIRE TAKE-UP MECHANISM

FIELD OF THE INVENTION

The present invention relates to a wire take-up mechanism, and more particularly to a unidirectional wire take-up mechanism.

BACKGROUND OF THE INVENTION

With the development of curtain products, electric curtains that can be opened and closed automatically are an important development tendency for curtain products because of their convenient operation. Most of the existing electric curtains use a motor assembly as a driving device to drive a corresponding rope collecting device, thereby realizing the automatic opening and closing of the curtain.

However, although the wire take-up mechanism in the existing rope collecting device can satisfy the wire take-up function, when the wire is released, the entire weight of the curtain body is pulled by the traction force of the motor to maintain the balance and positioning purpose. Such electric curtains have the problem of high energy consumption, especially for large-sized curtains, the power of the motor used is larger and the energy consumption is higher. In addition, when the size of the curtain body is relatively large and the weight is relatively heavy, the speed and impact force of the curtain are relatively large, which affects the service life of the motor and the quality of the curtain product.

SUMMARY OF THE INVENTION

In view of the deficiencies of the prior art, the present invention provides a unidirectional wire take-up mechanism that is ingenious and reasonable in structure design and can provide a reaction force when the wire is released.

In order to achieve the above object, the present invention provides the following technical solutions:

A unidirectional wire take-up mechanism comprises a fixing seat, a reel, a spindle, a unidirectional bearing, a bearing sleeve, a damping bounce member, and a positioning shaft. The reel is located in an inner cavity of the fixing seat. One end of the reel is provided with a rotating shaft. A side wall of the inner cavity is provided with a shaft hole corresponding to the rotating shaft. The bearing sleeve is fitted on the unidirectional bearing. The unidirectional bearing is disposed in the reel through the bearing sleeve. The spindle is disposed in the unidirectional bearing. One end of the positioning shaft is fixed to another side wall of the inner cavity. Another end of the positioning shaft is inserted into the reel and connected to one end of the spindle through the damping bounce member.

Preferably, the reel includes a cylindrical wheel body and an end cap. The cylindrical wheel body has a mounting cavity therein. The end cap covers an opening of the mounting cavity. The end cap has a central perforation through which the positioning shaft is inserted.

Preferably, the damping bounce member is a spring. One end of the spring is disposed on the positioning shaft, and another end of the spring is disposed on the spindle.

Preferably, the damping bounce member is a spring. One end of the spring is disposed on the positioning shaft, and another end of the spring is disposed on the spindle by an interference fit.

Alternatively, the damping bounce member is a rubber sleeve. The rubber sleeve is fixed on the positioning shaft. A wall of an inner hole of the rubber sleeve is fitted on the spindle by an interference fit.

Preferably, a wear-resistant sleeve is fixedly sleeved on the spindle.

Preferably, the wear-resistant sleeve is a stainless steel sleeve.

The present invention has a beneficial effect and a clever design. Through the arrangement of the unidirectional bearing and the damping bounce member, the unidirectional bearing can be freely rotated in one direction and locked in the other direction. When the curtain is pulled down, the unidirectional bearing is locked, and the reel links the spindle through the bearing sleeve to rotate counterclockwise. When the spindle is rotated, the spindle and the damping bounce member generate a frictional force to form a damping effect, thereby providing a reaction force when the wire is released and offsetting part of the gravity of the curtain and effectively slowing down the speed and impact force when the curtain falls, so that the up and down movement of the curtain is more stable. Furthermore, the load of the torque spring assembly is reduced, the energy consumption is reduced, and the load capacity of the torque spring assembly is increased. When the curtain is rolled up, the reel links the bearing sleeve to rotate clockwise relative to the spindle, and the spindle and the damping bounce member have no relative movement, and the rotation has no resistance. The restoring force of the damping bounce member enables the curtain to be pulled more smoothly. The overall structure is compact, small in size, easy to implement, and beneficial for widespread application.

Embodiments of the present invention will now be described, by way of example only, with reference to the accompanying drawings.

DESCRIPTION OF THE PREFERRED EMBODIMENTS

Figure 1:
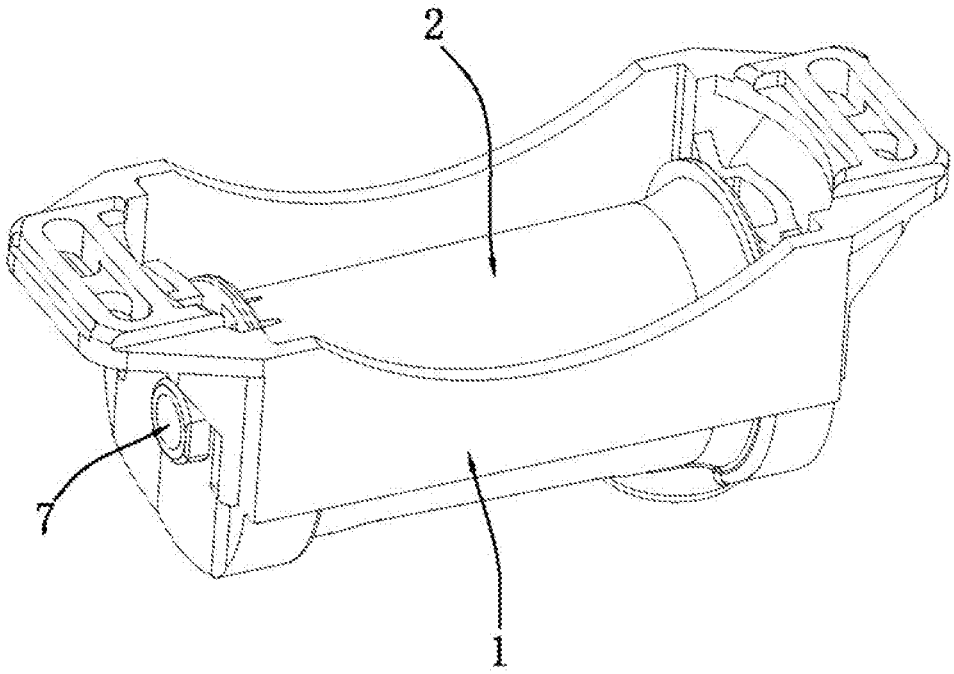
FIG. 1 is a perspective view of the present invention.
Figure 2:
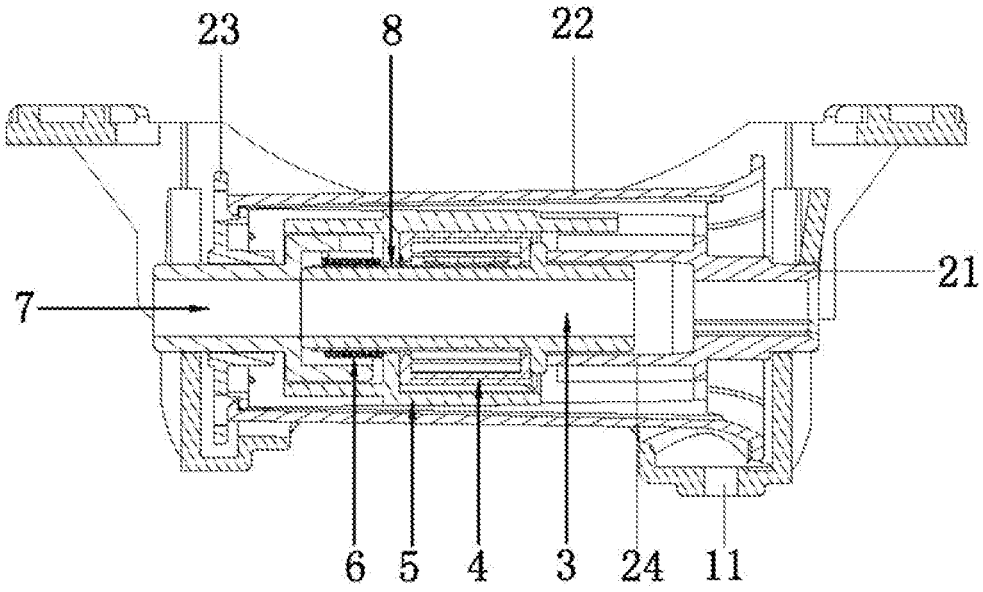
FIG. 2 is a cross-sectional view of the present invention.
Figure 3:
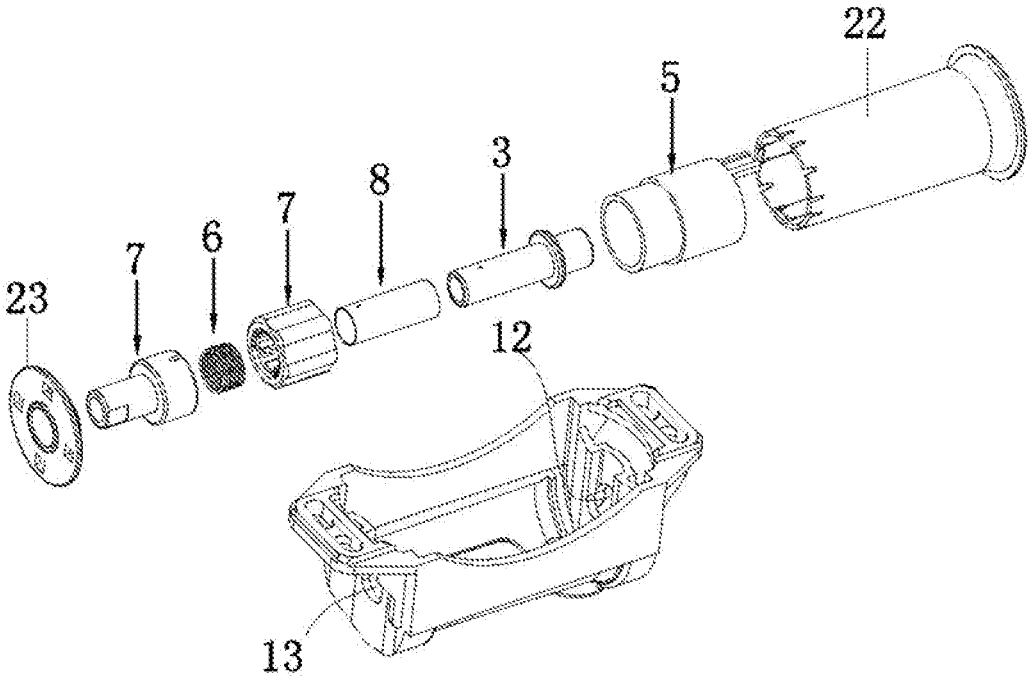
FIG. 3 is an exploded view of the present invention.

Referring to FIG. 1, FIG. 2 and FIG. 3, a unidirectional wire take-up mechanism in accordance with an the embodiment of the present invention comprises a fixing seat 1, a reel 2, a spindle 3, a unidirectional bearing 4, a bearing sleeve 5, a damping bounce member 6, and a positioning shaft 7.

The reel 2 is located in an inner cavity of the fixing seat 1. One end of the reel 2 is provided with a rotating shaft 21. A side wall of the inner cavity is provided with a shaft hole 12 corresponding to the rotating shaft 21. Specifically, the reel 2 includes a cylindrical wheel body 22 and an end cap 23. The cylindrical wheel body 22 has a mounting cavity therein. The end cap 23 covers an opening of the mounting cavity. The end cap 23 has a central perforation through which the positioning shaft 7 is inserted. The bottom surface of the fixing seat 1 is provided with a wire outlet 11.

The bearing sleeve 5 is fitted on the unidirectional bearing 4. The unidirectional bearing 4 is disposed in the mounting cavity of the reel 2 through the bearing sleeve 5. The spindle 3 is disposed in the unidirectional bearing 4. In order to improve the stability during operation, the mounting cavity is provided with a sleeve portion 24 matched with the spindle 3. The bore diameter of the sleeve portion 24 is matched with the diameter of the spindle 3. The right end of the spindle 3 is inserted into the sleeve portion 24.

One end of the positioning shaft 7 is a square shaft. Another side wall of the inner cavity is provided with a square hole 13 matched with the square shaft. The positioning shaft 7 is fixed to the other side wall of the inner cavity through the square shaft engaged into the square hole 13. Another end of the positioning shaft 7 is inserted into the reel 2, and is connected to the left end of the spindle 3 through the damping bounce member 6.

In this embodiment, the damping bounce member 6 is a spring. One end of the spring is disposed on the positioning shaft 7, and another end of the spring is disposed on the spindle 3. Specifically, the positioning shaft 7 is provided with an engaging recess for positioning and fixing one end of the spring, and the outer peripheral surface of the spindle 3 is provided with an engaging hole for positioning and fixing the other end of the spring. In other embodiments, the connection may be achieved by soldering or gluing. When working, the reaction force is generated by the deformation of the spring itself, which has a certain damping effect and rebounding ability, thereby offsetting part of the gravity of the curtain and effectively slowing down the speed and impact force when the curtain falls, so that the up and down movement of the curtain is more stable. Furthermore, the load of the torque spring assembly is reduced, the energy consumption is reduced, and the load capacity of the torque spring assembly is increased.

In other embodiments, one end of the spring may be disposed on the positioning shaft 7, and the other end of the spring is sleeved on the spindle 3 by an interference fit, that is, the inner ring of the spring is small, and is forcibly sleeved on the spindle 3. The reaction force is generated by the friction between the spindle 3 and the spring, which also has a certain damping effect. In addition, the damping bounce member 6 may be a rubber sleeve. One end of the rubber sleeve is fixed on the positioning shaft 7. The diameter of the inner hole of the rubber sleeve is less than the diameter of the spindle 3. The rubber sleeve is forcibly sleeved on the spindle 3. The wall of the inner hole of the rubber sleeve is fitted on the spindle 3 to form an interference fit structure with the spindle 3. The reaction force is generated by the friction between the spindle 3 and the wall of the inner wall of the rubber sleeve, which also has a certain damping effect.

Preferably, in order to prolong the service life, a wear-resistant sleeve 8 is fixedly sleeved on the spindle 3. In this embodiment, the wear-resistant sleeve 8 is preferably a stainless steel sleeve, which has good wear resistance, protects the spindle 3 from being damaged effectively, and prolongs the service life of the spindle 3. In other embodiments, the wear-resistant sleeve 8 may be a copper sleeve, a wear resistant ceramic sleeve or the like.

In use, through the arrangement of the unidirectional bearing 4 and the damping bounce member 6, the unidirectional bearing 4 can be freely rotated in one direction and locked in the other direction. In this embodiment, the unidirectional bearing 4 can be freely rotated in the clockwise direction and locked in the counterclockwise direction as an example. When the wire is taken up, the reel 2 links the bearing sleeve 5 to rotate clockwise relative to the spindle 3, and the spindle 3 and the damping bounce member 6 have no relative movement, and the rotation has no resistance. When the wire is released, the unidirectional bearing 4 is locked, and the reel 2 links the spindle 3 through the bearing sleeve 5 to rotate counterclockwise. When the spindle 3 is rotated, the spindle 3 and the damping bounce member 6 generate a frictional force to form a damping effect, thereby providing a reaction force when the wire is released. The restoring force of the damping bounce member enables the curtain to be pulled more smoothly, thereby offsetting part of the gravity of the curtain and effectively slowing down the speed and impact force when the curtain falls, so that the up and down movement of the curtain is more stable. Furthermore, the load of the torque spring assembly is reduced, the energy consumption is reduced, and the load capacity of the torque spring assembly is increased. The present invention has significant advantages over the conventional take-up mechanisms.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A unidirectional wire take-up mechanism, comprising a fixing seat, a reel, a spindle, a unidirectional bearing, a bearing sleeve, a damping bounce member and a positioning shaft, the reel being located in an inner cavity of the fixing seat, one end of the reel being provided with a rotating shaft, a side wall of the inner cavity being provided with a shaft hole corresponding to the rotating shaft, the bearing sleeve being fitted on the unidirectional bearing, the unidirectional bearing being disposed in the reel through the bearing sleeve, the spindle being disposed in the unidirectional bearing, one end of the positioning shaft being fixed to another side wall of the inner cavity, another end of the positioning shaft being inserted into the reel and connected to one end of the spindle through the damping bounce member.

2. The unidirectional wire take-up mechanism as claimed in claim 1, wherein the reel includes a cylindrical wheel body and an end cap, the cylindrical wheel body has a mounting cavity therein, the end cap covers an opening of the mounting cavity, and the end cap has a central perforation through which the positioning shaft is inserted.

3. The unidirectional wire take-up mechanism as claimed in claim 1, wherein the damping bounce member is a spring, one end of the spring is disposed on the positioning shaft, and another end of the spring is disposed on the spindle.

4. The unidirectional wire take-up mechanism as claimed in claim 1, wherein the damping bounce member is a spring, one end of the spring is disposed on the positioning shaft, and another end of the spring is disposed on the spindle by an interference fit.

5. The unidirectional wire take-up mechanism as claimed in claim 1, wherein the damping bounce member is a rubber sleeve, the rubber sleeve is fixed on the positioning shaft, and a wall of an inner hole of the rubber sleeve is fitted on the spindle by an interference fit.

6. The unidirectional wire take-up mechanism as claimed in claim 1, wherein a wear-resistant sleeve is fixedly sleeved on the spindle.

7. The unidirectional wire take-up mechanism as claimed in claim 6, wherein the wear-resistant sleeve is a stainless steel sleeve.

* * * * *